United States Patent [19]

Speers

[11] 4,029,510

[45] June 14, 1977

[54] MULTI-SOLUTION PHOTOGRAPHIC PROCESSING METHOD USING MULTI-COMPONENT DEVELOPER COMPOSITIONS

[75] Inventor: Daniel Earle Speers, Miami, Fla.

[73] Assignee: General Film Development Corporation, Southport, Conn.

[22] Filed: Dec. 23, 1974

[21] Appl. No.: 535,785

Related U.S. Application Data

[63] Continuation-in-part of Ser. No. 273,048, July 19, 1972, abandoned.

[52] U.S. Cl. ..... 96/61 R; 96/66 R

[51] Int. Cl.[2] ..... G03C 5/30; G03C 5/38

[58] Field of Search ..... 96/66.1, 66.2, 66.4, 96/66.5, 61 R, 61 M, 50 R, 50 A

[56] References Cited

UNITED STATES PATENTS

| | | | |
|---|---|---|---|
| 2,834,676 | 5/1958 | Stanley et al. | 96/66 R |
| 2,891,861 | 6/1959 | Welliver | 96/66.2 |
| 3,545,971 | 12/1970 | Barnes et al. | 96/61 |
| 3,647,459 | 3/1972 | Taber et al. | 96/66.5 |
| 3,674,491 | 7/1972 | Iijima et al. | 96/66.3 |
| 3,687,669 | 8/1972 | Iijima et al. | 96/66.3 |
| 3,715,214 | 2/1973 | Kane | 96/61 R |
| 3,806,344 | 4/1974 | Speers | 96/66.3 |

FOREIGN PATENTS OR APPLICATIONS

| | | | |
|---|---|---|---|
| 601,540 | 7/1960 | Canada | 96/66.2 |
| 871,571 | 6/1961 | United Kingdom | 96/66.1 |

OTHER PUBLICATIONS

Mason, Photographic Processing Chemistry, 1966 pp. 136–141.

*Primary Examiner*—Mary F. Kelley
*Attorney, Agent, or Firm*—Parmelee, Johnson & Bollinger

[57] ABSTRACT

An improved silver halide film, multi-solution photographic processing method and compositions having an increased speed of processing while producing good quality images including use of a developer solution having at least two, and preferably three, different developing agents and a fixing solution which is a combination of at least two different fixing agents. The process and compositions are particularly suitable for convenient processing of *x*-ray film and microfilm under ordinary room temperature conditions and also for processing in small machines. Following processing, a wash in an archival quality promoting solution is beneficial for microfilm. The *x*-ray film processing compositions find advantageous utility in the processing of dental *x*-rays and may conveniently be provided in powder form, for packaging and shipping, with dissolution by the end user.

9 Claims, No Drawings

MULTI-SOLUTION PHOTOGRAPHIC PROCESSING METHOD USING MULTI-COMPONENT DEVELOPER COMPOSITIONS

This application is a continuation-in-part of my copending application Ser. No. 273,048 filed July 19, 1972 now abandoned.

BACKGROUND OF THE INVENTION

This invention relates to photographic processing methods and compositions for black and white or monochrome silver halide emulsion films, and more particularly, to methods and compositions for convenient effective rapid processing of microfilm and *x*-ray film.

Many special purpose films that find use in the scientific, medical and information storage fields must produce fine grain, good quality images to be acceptable. Thus, in the scientific and medical fields detail of image must be readily ascertainable so that the viewer may correctly interpret the reproduction to pursue a further course of action or make an accurate diagnosis. In the information storage area, archival image quality, in addition to detail, is necessary for permanent record keeping and films which fade after a number of years are unacceptable. Additionally, *x*-rays must frequently be retained for medical and/or legal purposes for a period of time, often fixed by law.

Often, however, the foregoing desired properties of films finding utility in those areas such as *x*-ray film and microfilm, are sacrificed to the necessary expedient of rapid photographic processing. The magnitude of microfilm generated by every day business, scientific and academic operations requires that commercial establishments be able to process such a film in as short a time as possible. For example, commercial institutions, such as banks and the like, microfilm records of daily transactions including account statements, checks, etc. and often desire return of the processed film prior to the start of the next business day.

Rapid processing of *x*-ray film is frequently of even greater importance than with other films. In addition, *x*-ray film, particularly dental *x*-ray film, must often be processed under conditions and with equipment that lack the sophisticated quality control of a commercial processing laboratory. Thus, in ongoing surgical procedures, *x*-ray images of the area of interest are many times desired by the physician in a matter of minutes or even seconds although the need for accuracy and detail remains an important criteria. Dental *x*-rays are often developed and studied while the patient remains in the dentist's chair awaiting further work. Under such cimcumstances the processing is desirably accomplished in the dentist's office under a minimum number of constraints due to the need to closely control processing variables. At the same time, acceptable image quality, such as density and contrast, must be preserved.

SUMMARY OF THE INVENTION

The photographic processing method and compositions of this invention overcome problems and shortcomings associated with the good quality-short processing time dichotomy and enable extremely rapid processing of microfilm and *x*-ray film, compared to currently available products, without unacceptable sacrifice or compromise or desired properties such as density, fine grain and lasting good quality images. Advantageously, the method and compositions of this invention permit rapid processing at normal ambient room temperatures, thus eliminating the need for time consuming and costly procedures to provide bath temperature control, while preserving acceptable film density and contrast. Also, continuous and vigorous agitation during processing are not required, thus significantly increasing convenience of use.

The processing solutions utilizing the compositions of this invention are long lasting, both in shelf life and in processing capacity, so that they may be prepared and permitted to stand at ambient room temperature ready for use upon processing. The solutions may be replenished to extend their processing life. The compositions of this invention advantageously lend themselves to packaging in dry form for mixing and dissolution by the user when required. Consequently, shipment and storage are facilitated.

The foregoing is achieved, according to the present invention, by a processing method including in use therein a developer solution which is a combination of at least two, and preferably three, different developing agents and a fixing solution which is a combination of at least two different fixing agents. By immersing the silver halide emulsion film in the multi-component developer solution until the desired image density is obtained followed by immersing the film in a separate fixing solution containing at least two fixing agents, a minimum of processing time is expended.

In my copending patent application Ser. No. 240,275, filed Mar. 31, 1972, for "Three Component Developer For Photographic Processing Monobath Composition And Method," now U.S. Pat. No. 3,806,344, is disclosed an improved combined developer-fixer monobath photographic processing composition, and method of use therefor, possessing short processing time, stability, and extended period of activity while producing fine grain, good quality images including a developer which combines three developing agents. The present invention provides even more rapid processing than the fast processing disclosed in said application and is particularly suited to the convenient processing of *x*-ray film and microfilm under noncommercial processing laboratory conditions and to continuous processing in small machines.

Subsequent to processing in the developing and fixing solutions of this invention, the film may be washed in an archival quality promoting wash which enhances the image retention time to permit long time storage without deterioration of the film image.

Accordingly, a feature of this invention is to provide a multi-solution photographic processing method and composition which will enable the convenient rapid processing of *x*-ray film and microfilm at ambient room temperatures, for example, 20°–24° C (68°–75° F) while producing acceptable film contrast and density, fine grain and good qualtity images.

A further feature is the provision of a photographic processing method and composition which is highly suitable for use in continuous machine processing of *x*-ray film and microfilm.

An additional feature of this invention is the provision of a developer composition including multiple developing agents and a fixing composition, for complementary use therewith, including multiple fixing agents. Another feature is the provision of a film wash which enhances the archival quality of the film image.

By carefully controlling the formulation of the microfilm photographic processing solutions, including the order of adding chemical constituents, solutions having good keeping properties and capable of extreme dilution without loss of processing activity are obtained. Replenishment for restoring processing capability is possible with both microfilm and *x*-ray film solutions. Thus, it is a yet further feature of this invention to provide photographic processing solutions and compositions having an extended activity life as well as a good shelf life and capable of utilization at extremely low concentrations and of being replenished.

DESCRIPTION OF THE PREFERRED EMBODIMENTS

The multi-solution photographic processing method of this invention utilizes a developing step and a fixing step while eliminating the need for the conventional processing step utilizing a stop bath between the developing and fixing processes. The developing process of reducing silver halide to metallic silver is accomplished in a developer solution containing a solvent, such as water, at least three developing agents, a preservative, alkali for activation or acceleration and a restrainer or antifoggant. The fixing solution for complementary use therewith contains at least two fixing agents for rendering the remaining silver salts water soluble. Lesser amounts of other silver complexing agents may also be included. By selected and controlled formulation and addition of chemical constituents the shelf and processing lives as well as the processing activity strength of the developing solution used may be enhanced. Wash in a specially formulated solution promotes archival quality of the processed film.

The *x*-ray film to which this invention is applicable is that sensitive film designed specifically for radiography. Generally, *x*-ray films carry an emulsion on both sides of the safety base to utilize the penetrating power and adsorption of *x*-rays in both emulsion layers. This double coating provides increased speed and contrast over single emulsion coating films. Since increasing the particle size of the silver halide grains facilitates the exposure reaction, high speed and *x*-ray films may contain comparatively large silver halide crystals, for example approximately $10^{-4}$ cm. diameter silver bromide crystals are used.

Microfilms used for micro copying desirably possess fine grain, high contrast and high resolving power, that is, the ability to define sharp edges, because the image is small. Microfilms are generally available both as noncolor sensitized and panchromatic emulsions.

The following examples illustrate the processes of this invention as well as the formulation of specific embodiments of the developing, fixing and washing compositions of the invention which are particularly advantageous in rapidly processing microfilm.

Example 1

| Developer Solution: Material | pH = 12–13 (12.75 at 23° C) Amount |
|---|---|
| Water | 1000 ml |
| Anhydrous Sodium Sulphite | 1 g |
| p-methylaminophenol sulphate (metol) | 5 g |
| Anhydrous Sodium Sulphite | 105 g |
| 1,4-dihydroxy-benzene (hydroquinone) | 45 g |
| Sodium Carbonate (anhydrous) | 10 g |
| Sodium Hydroxide | 40 g |
| 1-phenyl-3-pyrazolidone (Phenidone) | 2.8 g |
| Potassium Bromide | 8 g |

Example 1-continued

| Benzotriazole | 1.4 g |
|---|---|
| Fixing Solution: Material | pH = 5–6 (5.75 at 23° C) Amount |
| Water | 1200 ml |
| Anhydrous Sodium Sulphite | 5 g |
| Ammonium Chloride | 140 g |
| Potassium Metabisulfite | 10 g |
| Sodium Thiosulfate | 50 g |
| 28% Acetic Acid | 10 ml |
| Ammonium Hydroxide (28% solution) | 5 ml |
| Formaldehyde (Formalin) | 5 ml |
| Ammonium Thiocyanate | 210 g |

The formulation of solutions and processing cycle of Example 1 is preferred only for microfilm. A permanently fixed microfilm possessing a good density, 1.75 (Kodak Densitometer), plus a low base plus fog level, 0.00, was obtained when processed at 24° C (75° F) for 10 seconds, separated by a one second wash, in each solution. Generally, at a processing temperature of approximately 24° C (75° F), the film is immersed in the developer solution for approximately 8 to 12 seconds until the desired density is reached followed by immersion in the fixing solution for 8 to 12 seconds. Subsequent to fixation, the film is washed completely. The speed of processing may be increased by conducting the processing at higher temperatures. The formulation of Example 1 is not satisfactory for *x*-ray film because the desired density is not obtained in the times given and cleansing in that time is frequently incomplete. Thus, for satisfactory results with *x*-ray film the immersion time should be increased to approximately 30 seconds.

Ease of solution is best obtained by adding the chemical constituents in the order given above. Distilled water, free of impurities, is preferably used although tap water may be satisfactory depending upon its source. Demineralized water is also satisfactory and temporary water hardness may be alleviated by conventional means. The anhydrous sodium sulphite acts as a preservative while the sodium hydroxide is an accelerator. Sodium carbonate, also an alkali and weak accelerator, may function as a buffer. Potassium bromide and benzotriazole are restrainers or anti-foggants. Potassium metabisulfite is an acidifier as is acetic acid. Formaldehyde improves the exhaustion rate of the fixing solution and is also a hardener useful in combating film emulsion softening. Ammonium hydroxide and sodium thiosulfate in combination may exhibit improved fixing action over the thiosulfate alone. The hydroxide also serves to maintain the optimum pH level.

The improved characteristics of the above process and behavior of the solutions utilized therein are dependent upon the overall process steps and total composition of solution rather than upon the individual components. However, the primary constituents in the developer solution are the three developing agents p-methylaminophenol sulphate (common name - Metol) 1,4-dihydroxy-benzene (Hydroquinone) and 1-phenyl-3-pyrazolidone (Phenidone). The primary fixing agents are ammonium chloride plus sodium thiosulfate and ammonium thiocyanate in the above example. All of the chemicals utilized herein are commercially obtainable in several grades although the photographic grade is preferred.

The use of a developing solution containing at least three developing agents is preferred. However, I have also found a multi-solution process developing solutions containing two developing agents advantageous for rapid processing. Example 2 sets forth a process and formulations using a two component developing agent developing solution.

Example 2

| Developing Solution: Material | pH = 12–13 (12.9 at 23° C) Amount |
|---|---|
| Water | 1000 ml |
| Anhydrous Sodium Sulphite | 110 g |
| 1,4-dihydroxy-benzene | 25 g |
| 1-phenyl-3-pyrazolidone | 2.8 g |
| Potassium Bromide | 5 g |
| Benzotriazole | 0.45 g |
| Sodium Hydroxide | 27 g |
| Fixing Solution: | pH = 3–4 (I-3.15 II-3.40 at 23° C) |

| Material | Amount I. | Amount II. |
|---|---|---|
| Water | 1000 ml | 1000 ml |
| Potassium | 10 g | 35 g |
| Boric Acid | 10 g | — |
| Potassium Thiocyanate | 60 g | 80 g |
| Sodium Thiosulfate | 220 g | 220 g |
| 28% Acetic Acid | 20 ml | 20 ml |

Microfilm development in the developing solution at 15 to 30 seconds at 24° C results in good densities of 1.4 to 1.8 with a base plus fog level of 0.05 to 0.012. Fixing may take place in either bath I. or II. to clear well in 45 to 60 seconds at 24° C. Higher temperatures can shorten the processing cycle. The film is washed completely after processing. A shorter fixing time may be obtained by immersing the film, following immersion in the developing solution above, in a fixing bath having the following composition:

Example 3

| Fixing Solution: Material | pH = 6–7 (6.8 at 23° C) Amount |
|---|---|
| Water | 1000 ml |
| Ammonium Thiocyanate | 140 g |
| Ammonium Chloride | 150 g |
| Potassium Metasulphite | 12 g |
| 28% Acetic Acid | 20 ml |
| Ammonium Hydroxide (10N Solution) | 20 ml |

Fixation in the above bath at 24° C requires a processing time of 30 seconds only.

The processing times given for the developer of Example 2 for microfilm are also satisfactory for *x*-ray films to produce good to excellent densities, although the base plus fog level are even higher than those for *x*-ray film in Example 1 and thus generally not desirable. The microfilm times in the fixer are generally insufficient for *x*-ray films since uncleared and spotty films are obtained.

Subsequent to processing, the keeping properties of the microfilm may be improved by washing in an archival quality promoting wash. The wash compositions set forth in Examples 4 and 5 below have been found to possess the desired characteristics for archival quality preservation.

Example 4

| Material | Amount |
|---|---|
| Water | 1000 ml |
| Ammonium Carbonate | 100 g |

Example 5

-continued

| Material | Amount |
|---|---|
| Water | 1000 ml |
| Ammonium Hydroxide | 20 ml |
| Hydrogen Peroxide | 20 ml |

Example 6

| Developer Solution: Material | Amount |
|---|---|
| I. | |
| Water | 1000 ml |
| Anhydrous Sodium Sulphite | 5 g |
| p-Aminophenol Hydrochloride | 12 g |
| 1,4-dihydroxy-benzene | 20 g |
| Anhydrous Sodium Sulphite | 100 g |
| Potassium Bromide | 2.5 g |
| Benzotriazole | 1 g |

Set above solution aside while mixing the following:

| Material | Amount |
|---|---|
| II. | |
| Water | 250 ml |
| Anhydrous Sodium Sulphite | 25 g |
| Sodium Hydroxide | 15 g |
| 1-phenyl-3-pyrazolidone | 2.1 g |

Add the second solution to the first slowly and with constant stirring. The pH of the combined solution is 10.3 at 23° C.

| Fixing Solution: Material | Amount |
|---|---|
| I. | |
| Water | 1000 ml |
| Sodium Thiosulfate | 25 g |
| Ammonium Chloride | 200 g |
| 37% Formaldehyde solution (Formalin) | 50 ml |
| OR | |
| II. | |
| Water | 1000 ml |
| Sodium Thiosulfate | 25 g |
| Potassium Thiocyanate | 125 g |
| Potassium Alum | 60 g |
| 28% Acetic Acid | 40 ml |

The foregoing solutions are preferably prepared by adding the chemical constituents in the order set out above. The developer solution is prepared in two steps as described and demonstrates extremely good keeping properties. Moreover, the developer solution can stand dilution up to 100 times, although the greater the dilution the longer the processing time.

The film is immersed in the developing solution till sufficient developing to obtain the desired image density occurs. Fixing can be accomplished by immersing the film in the fixing solution of Example 1 or in either of the fixing solutions in Examples 2 and 3. Fixation continues until the remaining silver salts are satisfactorily removed. Processing times to accomplish the desired result are of the order set forth in Example 1 at 24° C processing temperature. The potassium alum and formalin in the fixing solutions serve to increase the stability, improve the rate of exhaustion and act as a hardener.

The following examples 7 through 10 illustrate the processes of this invention as well as the formulation of specific embodiments of the developing, replenishing and fixing compositions of the invention which are particularly advantageous in rapidly processing *x*-ray films.

Example 7

| Developer Solution: Material | pH = 12–13 (12.65 at 23 °) Amount |
|---|---|
| Water | 1000 ml |
| Sodium Sulfite (anhydrous) | 80.0 g |
| Hydroquinone | 26.0 g. |
| Sodium Hydroxide (flake) | 26.0 g |
| Phenidone | 2.2 g |
| Potassium Bromide (crystal) | 4.0 g |

Example 7-continued

| | |
|---|---|
| Benzotriazole | 1.0 g |
| Bromothymol Blue Solution | 5.0 ml |

The foregoing developer solution is suitable for x-ray film, such as Kodak Periapical Ultra Speed X-Ray Film, which may be developed in 8 to 12 seconds with immersion in the developer at usual ambient room temperatures, for example, 10 seconds at 20°–23° C (68°–72° F) having been found satisfactory. After development, fixing may be accomplished in a fixing solution having the composition given in Example 10 below. Alternatively, a faster fixation may be obtained, approximately 15 to 20 seconds at usual ambient room temperatures, with the following:

| Fixing Solution: Material | pH = 8–9 (8.15 at 23° C) Amount |
|---|---|
| Water | 1 l |
| EDTA Disodium Salt | 1.5 g |
| Sodium Sulphite (Anhydrous) | 34.4 g |
| Sodium Thiosulphate ($5H_2O$) | 137.4 g |
| Ammonium Chloride | 54.9 g |
| Ammonium Thiosulphate | 46.9 g |
| Ammonium Thiocyanate | 250 g |

The processing solutions may advantageously include a complexing agent such as tetra-or-di-sodium salt of ethylenediamine tetra acetic acid, for fixers or developers respectively, as a chelating agent for complexing metal ions and preventing them from interfering with the process.

A developer composition which has a long life, possesses a reduced susceptibility to oxidation even after mixing for use and may advantageously be packaged and shipped in a dry powder form is set forth in Example 8. The constituents are present in two separated packages to maintain the developer free from contact with the alkali until ready for use and thus reduce the possibility of oxidation during shipment and shelf storage prior to dissolution.

Example 8

| Developer — Powder Form Material | Amount |
|---|---|
| | (to make one gallon of solution) |
| Part A | |
| p-Methylaminophenol Sulphate | 12 g |
| Sodium Sulfite (anhydrous) | 25 g |
| Hydroquinone | 104 g |
| Phenidone | 4 g |
| Bromothymol Blue Dye | 0.0052 g |
| Part B | |
| EDTA Disodium Salt | 4 g |
| Sodium Hydroxide (flake) | 36 g |
| Sodium Sulfite (anhydrous) | 135 g |
| Potassium Bromide (crystal) | 4 g |
| Potassium Carbonate (anhydrous-granular) | 120 g |
| Benzotriazole | 0.2 g |

The pH of the foregoing when mixed with water to make one gallon of developing solution is between 10 and 11 (10.7 at 23° C) at the ordinary ambient room temperature processing conditions. At room temperature, processing time for *x*-ray film, such as Kodak Periapical Ultra Speed X-Ray Film, is less than 45 seconds for a clinically acceptable image, approximately 30 seconds with only an initial 5 second agitation required. If a development temperature below ambient room temperature is desired, the agitation time may be advantageously increased. Good density and low fog level are obtained. The potassium carbonate serves as a buffer which reduces the oxidation and provides a longer processing life. The bromothymol blue dye may be utilized as an indication of the life of the solution. As the developer of Example 8 oxidizes, its pH increases and the following replenisher may be advantageously used.

Example 9

| Replenisher — Powder Form Material | Amount |
|---|---|
| | (to make one pint of solution) |
| EDTA Tetrasodium Salt | 0.25 g |
| p-Methylaminophenol Sulfate | 1.00 g |
| Sodium Sulfite (Anhydraus) | 22.0 g |
| Hydroquinone | 30.0 g |

Depending on usage and storage conditions, the replenishment should start after 3,000 to 5,000 square inches of film have been processed. The rate of replenishment should be 3.0 ounces liquid per 1,000 square inches of film processed.

A fixer which may be advantageously used in total processing in conjunction with the developer of Example 8 and which may also be packaged and shipped in dry form has a composition as follows.

Example 10

| Fixer — Powder Form: Material | Amount |
|---|---|
| | (to make one gallon of solution) |
| EDTA Tetrasodium Salt | 4 g |
| Sodium Sulfite (anhydrous) | 87 g |
| Sodium Thiosulfate (anhydrous) | 443.4 g |
| Ammonium Chloride | 139 g |
| Ammonium Thiosulfate | 118.7 g |

When mixed with water to make one gallon of solution, the pH is 7–8 at ambient room temperatures (7.65 at 23° C). Fixing of *x*-ray film at those conditions takes approximately 30 seconds.

EXAMPLE 11

The purpose of this example was to compare the chemical properties and results obtained with the developer and fixer of this invention, Examples 8 and 10, with those of other so called rapid processing developers and a conventional developer in a manner similar to that reported in "Evaluation of Film Processing With Concentrated Solutions," L. R. Manson-Hing et al, Oral Surgery, August, 1973, pp. 280–286. Exposure conditions were maintained constant while processing temperatures and other variables, such as agitation, were adjusted according to each manufacturers recommendations. The film used was Kodak Periapical Ultra Speed X-Ray Film, Poly soft, DF-58 (Catalog No. 165-8194) ANSI-Type 1. 2, AN Standard Speed Group D, 1¼ inch by 1⅝ inch. Exposure was in a leaded box using an aluminum step wedge having nine steps from 1.5 mm. to 14.0 mm. and a tenth step of lead. Exposure was by a Kramex diagnostic *x*-ray unit with a MA/KVP of 15/70, 0.25 seconds exposure time with a tube to film plane distance of 5⅝ inches.

The developers and fixers evaluated were:

A. Examples 8 and 10
B. Kodak Liquid X-Ray Developer and X-Ray Fixer (Eastman Kodak Co, Rochester, New York)
C. Instant Film Processing (IFP) Developer and Fixer (M and D International Enterprises, Carpinteria, California 93013)
D. Insta-Neg and Insta-Fix (Microcopy Division Neo-Flo, Inc., Culver City, California)
E. Collit's Rapid X-Ray Developer (Buffalo Dental Mfg. Co., Brooklyn, New York)

I. Processing Conditions

The following chart lists the recommended times and temperatures:

| | | I TIME AND TEMPERATURE | | | | |
|---|---|---|---|---|---|---|
| Developer | pH | 64° F | 68° F | 72° F | 80° F | 92° F |
| A | 10.65 | 50 sec. | 38 Sec. | 30 Sec. | 20 Sec. | 10 Sec. |
| B | 11.30 | 6 Min. | 4½ Min. | | 20 Min.–15 Sec. | 1 Min.–15 Sec. |
| C | 12.85 | 30 Sec. | 23 Sec. | | 9 Sec. | 4 Sec. |
| D | 12.80 | 50 Sec. | 30 Sec. | | 15 Sec. | 5 Sec. |
| E | 13.40 | | 15 Sec. | | | |

Exposed films were agitated in solutions according to each manufacturer's recommendations.

A. — Five second initial agitation
B. — No agitation
C. — Agitate film constantly and vigorously during the entire development by means of a rapid wrist action as opposed to an up and down arm movement.
D. — From the time the film is immersed — continual and vigorous agitation is essential for best results.
E. — No directions on package — Continuous agitation was used.

Because methods of agitation can vary from person to person and time to time, each test was repeated and the results were averaged.

All films were washed under continually flowing water for five minutes. They were then soaked in a wetting agent (Kodak Photo-Flo) and allowed to air dry at room temperature. Fixing was also according to manufacturer's recommendation.

II. Results

Densities - Base plus fog comparison

| | II TEMPERATURE AND DENSITY | | | | |
|---|---|---|---|---|---|
| Solution | 64° F | 68° F | 72° F | 80° F | 92° F |
| A | 0.11 | 0.14 | 0.17 | 0.17 | 0.19 |
| B | 0.17 | 0.19 | | 0.21 | 0.25 |
| C | 0.19 | 0.19 | | 0.20 | 0.20 |
| D | 0.32 | 0.27 | | 0.25 | 0.21 |
| E | | 0.16 | | | |

The above data shows that as a general trend, FOG plus BASE DENSITY increased as the temperature increased, except for INSTA-Solutions which decreased in density as the temperature increased. The invention (A) maintained the lowest densities through all of the temperatures. There was only one reading for Collit's (E) since the manufacturer recommends only one time and temperature. A density for the invention at 72° F was taken since this is the recommended temperature, ambient room temperature.

Base densities of the step wedge were measured at 68°, the recommended processing temperature for optimum results for Kodak (B), IFP (C), INSTA (D), and Collit's (E), and at the recommended processing times. The Kodak developer, considered as a conventional developer, showed greater density than all of the rapid processing solutions. This result can be attributed to the much longer developing time. The invention bettered the rapid processing solutions in contrast and in amount of density. Results for the invention at 72° F as compared to the others at 68° F showed increased density, thus bringing it closer to that of the conventional chemistry.

All of the developers showed a similar starting point with a variation of 0.08 in density with INSTA as the lowest starting point and the invention as the highest starting point. There was a variation of 1.52 in density at the end point of the scale with Collit's showing the lowest end point and Kodak showing the highest end point. It is pointed out that variations in density at the low density end of the scale are visually much more noticeable than the variations at the high density end of the scale.

Film densities of the step wedge at 68° F and at 50 and 150 percent of the recommended processing times were measured. It was observed that, compared to the recommended time, development at 50 percent of the recommended time produced a reduced density for all of the developers. Kodak and Collit's indicated the largest drop in density (0.70 to 0.96) at the high density end of the graph. The invention dropped about one half of a density point (0.56). The drop in density reduced the contrast in all of the film. The invention, Kodak, IFP, and INSTA still had readable results; however, Collit's had lost too much density and contrast to be a visually readable radiograph.

At the greater time, one and a half the recommended time, an increase in density was observed. Kodak showed an increase in contrast such that much of the detail at the high density end of the scale was blocked — in or not visually readable. A curve of the results is so steep that there is too much separation in the steps of the middle area of the wedge, thus producing a loss of valuable detail.

The invention showed an increase of about 0.2 in density at the high density end of the scale. This indicated the invention's ability to retard development after it has reached a standard high point.

A comparison of film densities of the step-wedge at 64° F, 68° F, 72° F, 80° F, and 92° F and at the recommended processing times for each of the temperatures was also made. The comparison indicated that the invention's developing ability tends to increase as the temperature increased. Starting with 64° F it has an effect equal to that of the other rapid developers, but less than that of Kodak. However, as the temperature increases the invention tends to increase the density over that of the other rapid developers, and tends to move closer to the densities of the Kodak product. The conclusion of this comparison is that the invention has a rapid processing time while achieving the results obtainable with a conventional slow processing developer. These results are better than those obtained with the other rapid developers.

A comparison of development capacity at 68° F and at the recommended processing times was made by noting the high and low point densities of each of 30 films, consecutively processed in each of the developers. The developing vessel held 15 milliliters and the level was replenished at intervals of every 10 films, approximately 20.3 square inches, with the developer diluted to one third of its strength. The average level replenishment amount was 3 milliliters. It was evident that very little could be determined at the low density point of the scale and much more could be seen at the high density end of the scale. All of the rapid developers showed a relatively constant developing level for 30 radiographs. Kodak however, showed a drastic drop in density after the tenth film. It should be noted that the invention possessed a reasonably constant level of densities for the 30 films. The other rapid solutions showed sporadic variation for the 30 films.

Shelf life and the possible affect of adverse storage conditions on the invention were evaluated. A package of the invention developer powder was stored for four months at a reasonably constant room temperature under ordinary shelf conditions, that is, ambient room conditions. At the end of four months the powder was mixed with water, and *x*-ray films were processed. The results indicated no significant variation over a standard, a fresh mix of the developer. Another package was stored for 30 days in a chamber which kept the temperature at a constant 130° F and the humidity at a 95 to 100 percent level. At the end of this period the powder was mixed and films were processed. Again no significant variation over the standard was observed.

It should also be noted that the invention has the lowest pH value of all the developers compared. The significance of a low pH is that it is less likely to cause skin irritation and is less subject to oxidation. As the developer of the invention is used the pH value tends to increase although the normal trend for a developer is to decrease in pH value as it is used. The benefit of this surprising trend is that a non-alkali replenisher can be used to maintain the original pH value and to maintain the developing ability.

From the foregoing, it can be seen than an *x*-ray film rapid developer according to this invention, in general, has better qualities than those of other rapid developing solutions and equal if not better than those of a conventional developer. Moreover, the invention developer's keeping qualities outlast those of the other rapid solutions and equal that of the conventional developer. The developing and fixing ability of the compositions of the invention is equal to that of the rapid solutions at lower temperatures. It is better than the rapid solutions and equals that of the conventional developer at higher temperatures. Advantageously, the invention developer has an excellent developing latitude thus salvaging any over or under development errors.

The invention developer's base and fog level is lower at all recommended temperatures than those of the other rapid solutions and of the conventional solution as well. In addition, its developing capacity is equal to the other rapid solutions' capability and much greater than the conventional capacity. The invention's dry powder form developer shelf life storage is equal to if not better than that of the liquid developer and will not be affected by high or low temperature variations. Possibility of spillage, with its concomitant safety hazards, or due to liquid container breakage during shipping and handling is reduced. Additionally, the requirement of a minimal initial agitation, only, reduces the handling of the film and helps to preserve the processing solution.

The photographic processing methods and compositions of this invention have a general wide applicability but are particularly suitable for rapid processing of *x*-ray film and microfilm under ordinary ambient room temperature conditions. In commercial machine processing where film is passed essentially continuously or intermittently through developing, fixing and wash tanks the uses of the processing compositions of this invention results in considerable savings in time and effort and greater economy in apparatus by reducing the size of the tanks required as well as the time of operator attention thereto. Thus, improved *x*-ray film and microfilm processing methods and compositions have been provided herein.

I claim:

1. A dry powder form fixer which when dissolved is capable of rapidly fixing developed *x*-ray film, of the type such as is used in dental *x*-rays, under ordinary ambient room temperature processing conditions comprising, in dry form, anhydrous sodium sulphite, anhydrous sodium thiosulphate, ammonium chloride and ammonium thiosulphate.

2. The method of rapidly developing silver halide film of the type such as is used as dental *X*-ray film at ordinary ambient room temperature processing conditions to produce a developed film which is clinically acceptable imagewise as resulting from the exposed *X*-ray film comprising immersing the exposed *X*-ray film for no longer than approximately 30 seconds, and with only an initial 5 second agitation of the immersed film, in an aqueous developer solution at ordinary ambient room temperature processing conditions, said developer solution having a pH in the range of 10 to 11 at 23° C (73° F), said aqueous developer solution including only the following three developing agents: p-methylaminophenol sulphate, 1,4-dihydroxy-benzene and 1-phenyl-3-pyrazolidone, and including anhydrous sodium sulphite for acting as a preservative, sodium hydroxide for acting as an accelerator, potassium bromide for acting as an anti-foggant and potassium carbonate for acting as a buffer for reducing oxidation, thereby producing developed dental X-ray film which is clinically acceptable imagewise within said short time period under such convenient ambient room temperature processing conditions.

3. The method of rapidly developing silver halide film of the type such as is used in dental X-ray film at ordinary ambient room temperature processing conditions to produce a developed film which is clinically acceptable imagewise as resulting from the exposed X-ray film as claimed in claim 2, wherein as the developer solution oxidizes during use its pH advantageously tends to increase, thereby enabling a non-alkali replenisher to be used to maintain the original pH value and to maintain the developing ability.

4. The method of rapidly fixing X-ray film at ordinary ambient room temperature processing conditions which has been developed according to the method of claim 2, comprising immersing the developed X-ray film in an aqueous fixing solution having a pH of 7–8 at 23° C (73° F) comprising anhydrous sodium sulphite, anhydrous sodium thiosulphate, ammonium chloride and ammonium thiosulphate for no longer than approximately 30 seconds at ordinary ambient room temperature processing conditions.

5. The method of rapidly fixing an X-ray film at ordinary ambient room temperature processing conditions which has been developed according to the method of claim 2, comprising immersing the developed X-ray film in an aqueous fixing solution having a pH of 8–9 at 23° C (73° F) and comprising only the five following fixing agents: anhydrous sodium sulphite, sodium thiosulphate, ammonium chloride, ammonium thiosulphate and ammonium thiocyanate and including a chelating agent for complexing metal ions, for no longer than approximately 20 seconds at ordinary ambient room temperature processing conditions.

6. The method of providing an aqueous solution developer which is capable of rapidly photographically developing silver halide X-ray film, of the type such as is used in dental X-ray diagnosis for developing the film in a manner which is clinically acceptable imagewise under ordinary ambient room temperature processing conditions for no longer than approximately 30 seconds with only an initial 5 second agitation of the immersed exposed film comprising the steps of providing a first part of the developer including only the three following developing agents: p-methylaminophenol sulphate, 1,4-dihydroxybenzene, 1-phenyl-3-pyrazolidone and including anhydrous sodium sulphite as a preservative; providing a second part of the developer and maintaining said second part of the developer separate from the first part until time for use, said second part including sodium hydroxide, anhydrous sodium sulphite potassium carbonate and potassium bromide; and at the time for use mixing said parts together in aqueous solution to form said aqueous developer solution.

7. The method of providing an aqueous solution developer which is capable of rapidly photographically developing silver halide dental X-ray film, as claimed in claim 6, including providing bromothymol blue dye in said first part of the developer for acting as an indicator of the life of the aqueous developer solution; and providing benzotriazole in said second part of the developer for acting as an anti-foggant in the aqueous developer solution.

8. The method of providing an aqueous solution developer which is capable of rapidly photographically developing silver halide dental X-ray film, as claimed in claim 6, including the steps of supplying a non-alkali developer replenisher separate from said first and second parts of the developer and adding said non-alkali replenisher to the aqueous solution after usage thereof, said replenisher comprising p-methylaminophenol sulphate, 1,4-dihydroxy benzene, anhydrous sodium sulphite and ethylenediamine tetra acetic acid tetrasodium salt.

9. The method of providing an aqueous solution developer which is capatable of rapidly photographically developing silver halide dental X-ray film, as claimed in claim 6, including the step of providing an amount of anhydrous sodium sulphite in said second part of the developer which exceeds five times the amount thereof in said first part of the developer.

* * * * *